United States Patent [19]

Baird et al.

[11] 4,300,068

[45] Nov. 10, 1981

[54] ARTICLE CAPABLE OF CREATING A MOIRE EFFECT

[76] Inventors: Norman F. Baird, 9 Spencer Ct., Morris Plains, N.J. 07950; Louis J. Parascandola, 31 Merrill Rd., Clifton, N.J. 07012

[21] Appl. No.: 85,789

[22] Filed: Oct. 17, 1979

[51] Int. Cl.[3] ..... H01K 7/06

[52] U.S. Cl. ..... 313/315; 313/110; 313/116; 313/117; 362/351; 362/806

[58] Field of Search ..... 313/315, 110, 111, 112, 313/116, 117; 362/351, 806

[56] References Cited

U.S. PATENT DOCUMENTS

| | | | |
|---|---|---|---|
| 1,500,912 | 7/1924 | Williams | 313/111 |
| 2,220,145 | 11/1940 | Cooke | 313/111 |
| 3,215,883 | 11/1965 | McClees | 313/117 X |
| 3,462,632 | 8/1969 | Russi | 313/110 |

*Primary Examiner*—Saxfield Chatmon, Jr.
*Attorney, Agent, or Firm*—Darby & Darby

[57] ABSTRACT

An article, illustratively a lamp bulb envelope, for creating a moire effect has a plurality of transparent and nontransparent regions on its surface. When viewed from a point external to the envelope, the individual nontransparent regions on the surface of the envelope which is nearest to the point appear as superimposed upon and intersecting with nontransparent regions on the surface furtherest from the point. The apparent intersections produce a moire effect which is enhanced by varying the line of sight to the bulb. The family of moire curves appear as transversely running curves which pass through the points of apparent intersection of individual nontransparent regions along the near and far faces. The nontransparent regions may be either light diffusive (translucent) or light nontransmissive (opaque) in nature and may be created by abrading the surface of the envelope or by application of opaque or diffusive coatings onto the surface of the envelope. When an actual filament, arranged within the envelope, is energized to emit light, an apparent filament appears in inverted relationship with the actual filament within the envelope.

11 Claims, 5 Drawing Figures

ARTICLE CAPABLE OF CREATING A MOIRE EFFECT

It is known that the moire effect occurs when a family of actual curves is superimposed upon a second family of actual curves to produce a third family of apparent curves. In the moire effect, each of the individual curves of the third family of apparent curves passes through points of intersection defined by the individual curves of the first and second families of curves.

In the present invention, an incandescent electric lamp is provided which utilizes the moire effect to create a dynamic and decorative effect. A three-dimensional object, in the form of a lamp envelope in the preferred embodiment, is provided with a plurality of transparent regions which are each separated from the next adjacent transparent region by a nontransparent region. The nontransparent regions may be either translucent (light diffusive) or opaque (light nontransmissive) in nature.

When viewed from a point external to the object, the non-transparent regions on the surface of the object which is furtherest from the external point are discernible through the transparent regions on the surface of the object which is nearest to the external point. The nontransparent regions along the near surface of the object appear as superimposed upon and intersecting with the non-transparent regions along the far surface of the object. The apparent superimposition and intersection of nontransparent regions on the near and far surfaces of the object produces the moire effect, i.e. the effect that a third family of apparent curves passes through points of intersection defined by nontransparent regions on the near and far surfaces of the object. Relative movement between the observer and the three-dimensional body results in variation in both the pattern and orientation of the third family of curves.

The variation in the third family of curves creates a highly decorative effect when the pattern of transparent and nontransparent regions are applied to the envelope of an incandescent lamp.

In such a lamp, the filament creates a highly pleasing visual effect. Further, an apparent filament appears in inverted relationship with the actual filament when the filament is energized to produce light. The effect of an apparent filament, which also occurs in other lamps having nondiffusive finishes provides an additional decorative effect here.

It is an object of the present invention to provide a lamp envelope with a primary pattern of a plurality of non-transparent and transparent regions to create a decorative secondary effect.

It is another object of the invention to provide a lamp envelope in which the moire pattern varies in response to relative movement between the observer and the envelope to create a highly pleasing visual effect.

A preferred embodiment of the present invention is described with reference to the annexed drawings, in which.

Figure 1:
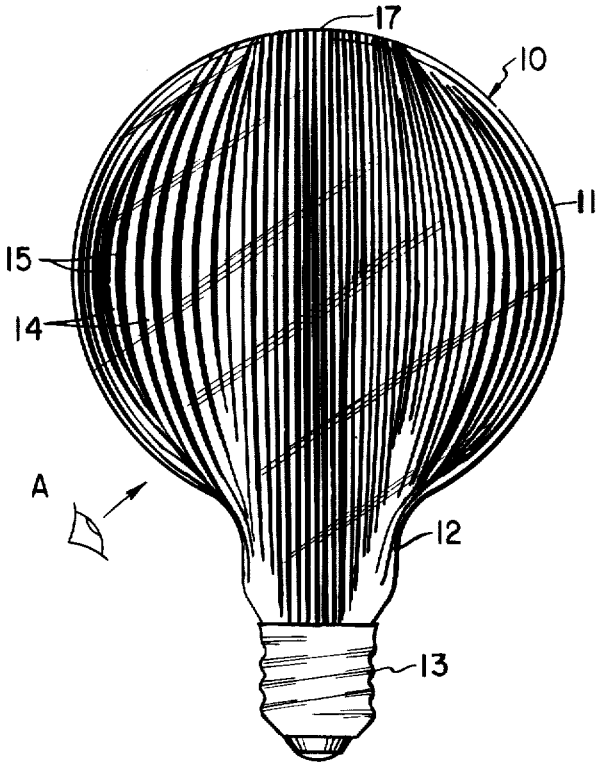
FIG. 1 is an elevational view of an article according to the present invention.

In accordance with the present invention, a three-dimensional object 10 is provided. Illustratively, the object 10 comprises the hollow, generally spherical, envelope 11 of an incandescent lamp. As shown in FIG. 1, the spherical portion 11 terminates in a tubular portion 12 to which a conventional electrical base 13 is connected.

Figure 2:
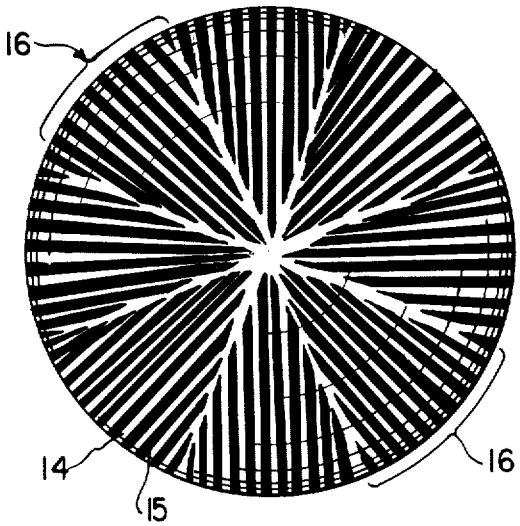
FIG. 2 is a plan view of the article depicted in FIG. 1.

As seen in FIGS. 1 and 2, a plurality of transparent regions 14 are provided in a predetermined pattern along the surface periphery of the lamp envelope 10 by laying down a plurality of nontransparent regions, such as lines 15. Each transparent region 14 is separated from the next adjacent transparent region by a nontransparent region 15. The nontransparent regions may be either light diffusive (translucent) or light nontransmissive (opaque). As shown, the surface of the envelope 10 appears as alternating strips of transparent regions 14 and nontransparent regions 15. Each individual region 14, 15 takes the shape of a solid arcuate segment which terminates at a lower portion of envelope 10. However, the individual regions may take a variety of alternative forms arranged in alternative configurations on or within the envelope 10. For example, the individual regions may be formed from geometric shapes such as triangles or dots arranged in various patterns to create the moire effect and each of the regions may illustratively comprise endless circular or spiral segments encompassing portions of the envelope.

As seen in FIG. 2, which is a top view of the envelope, the alternating strips of transparent and nontransparent regions 14 and 15 appear as bands 16 of strips which extend radially from the pole 17 of the spherical envelope 10 and terminate at electrical base 13. It should be apparent, however, that the strips 14, 15 may be arranged in a variety of alternative orientations along the surface of the envelope 10. For example, the individual strips 14, 15 may comprise endless line segments such as circular loops, and each of the individual strips 14,15 may extend along one of a plurality of parallel spaced horizontal, vertical or angled planes of envelope 10.

The nontransparent strips 15 can be created in a variety of ways. For example, portions of a generally transparent envelope 10 can be masked in conventional fashion. Abrasives, such as aluminum oxide, can then be used to abrade the unmasked portions of the envelope 10 so that they become nontransparent. A variety of conventional alternative methods may be utilized to produce the nontransparent portions. A variety of physical or chemical methods may be utilized to abrade or etch the surface of the workpiece or various diffused or opaque coatings may be applied to the workpiece surface to create the nontransparent regions.

When viewed from a point such as A, which is external to the envelope 10, portions of the far surface of the envelope 10 will be discernible through the transparent regions of the near surface of the envelope 10. The alternating transparent and nontransparent regions, 14 and 15 respectively, on each of the near and far surfaces takes the appearance of strips which extend along each of the near and far surfaces of the envelope. The nontransparent strips on the near surface of the object appear to intersect with the nontransparent strips on the far surface. Thus, when viewed from the external point A, one sees a first family of curves or strips along the near surface which are superimposed over and appear to intersect with a second family of curves along the far surface of the envelope 10. The apparent intersection of the first and second families of curves gives rise to a third family of apparent curves whose individual curves appear to pass through apparent points of intersection defined by individual curves of the first and second family of curves.

Figure 5:
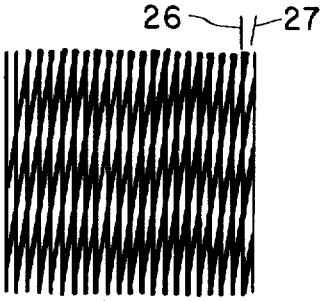
FIG. 5 depicts the moire effect produced by superimposition of first and second families of curves.

The general moire effect is shown in two dimensional space in FIG. 5. In FIG. 5 (Excerpt from Dictionary of Scientific and Technical Terms, D. N. Lapedes, Ed-in-chief, McGraw-Hill, N.Y., N.Y. 1974) a first family of curves run generally parallel to curve 26 and a second family of curves run generally parallel with curve 27 and intersect with the first family of curves. The family of apparent moire curves extend generally transverse to the first and second family of curves and pass through points of intersection between individual curves of the first and second family of curves. The moire effect is enhanced when the first and second family of curves are arranged in three-dimensional space, as in the present invention.

By changing the location of the external point A from which the envelope 10 is viewed, the orientation and the pattern of the third family of curves will vary since movement of the external point A relative to the envelope 10 varies the orientation between the external point A and portions of the near and far surfaces of envelope 10. This ability to vary the moire effect by relative movement of the external point A gives rise to a decorative effect when the envelope 10 comprises a conventional lamp bulb envelope. An observer viewing a lamp bulb in accordance with the present invention will observe a moire effect. By changing his or her line of sight to the envelope, for example, by simply moving one's head from side to side, the moire effect will vary dramatically.

Figure 3:
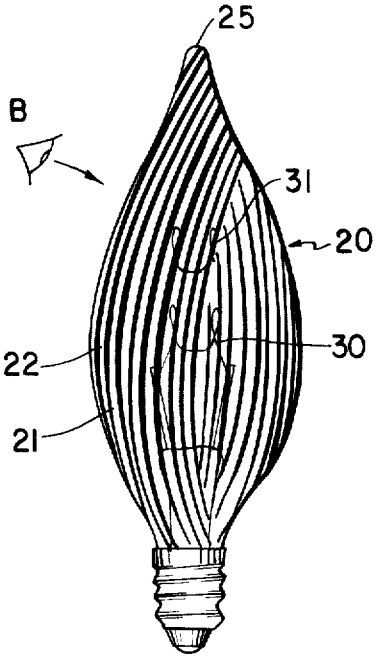
FIG. 3 is an elevational view of an alternative embodiment of the article.

In addition, when an actual filament 30 is energized to emit light, an apparent filament 31 appears within the envelope 20 and in inverted relationship to the actual filament, providing a further decorative effect (see FIG. 3). An actual filament disposed within envelope 10 will also result in the appearance of an apparent inverted filament within envelope 10. The use of a filament having low surface brightness increases the effect since the apparent filament such as 31 will be more readily observable.

Figure 4:
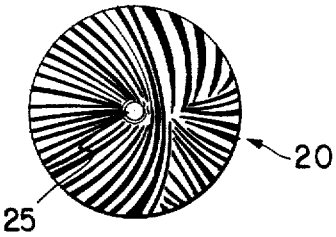
FIG. 4 is a plan view of the article depicted in FIG. 3.

In FIG. 3, another embodiment of a lamp envelope is shown. Envelope 20 is generally pear-shaped. A plurality of transparent regions 22 and nontransparent regions 21 are provided along the periphery of the envelope 20. The regions 21 and 22 are depicted as generally arcuate strips or curves. In the embodiment of FIGS. 3 and 4, the moire effect is discernible by viewing the envelope 20 from a point B external to the envelope. Through the transparent portions along the near face of the envelope, one observes a first family of curves superimposed over and intersecting with a second family of curves. One of these families of curves appears along the surface of the envelope 20 nearest to the external observation point and the other family of curves appears along the surface of the envelope 20 furthest from the external point B and is observed through the transparent portions on the near surface of envelope 20.

As shown in FIGS. 2 and 4, the strips 14, 15 and 21, 22 radiate from the vicinity of respective poles 17 and 25 located at the upper portion of the respective envelope. It should be apparent that the poles can be located anywhere on the surface of the envelope and that a plurality of poles can be utilized in place of the single pole depicted. In addition, it has been found that slight misalignment of the curves 14, 15 and 21, 22 from the respective poles 17 and 25 enhances the moire effect. Accordingly, the strips 14, 15 and 21, 22 are arranged in several bands so that the majority of individual strips are offset from the respective poles 17, 25.

In the case of light diffusive nontransparent portions, light scattered by the diffusive portions must compete with direct filament light to achieve the moire effect. Accordingly, in a preferred embodiment, a bulb having a large filament area and sufficiently low surface brightness to enable one to discern light which is scattered from the light diffusion regions is utilized. Similarly, in the case of opaque, nontransparent portions, excessive filament brightness can diminish the moire effect.

The transparent portions of the envelopes 10,20 may be either clear or colored. Coloring can provide an esthetically pleasing appearance. However, the coloring must not be so dark that the far face of the envelope surface cannot be discerned through the near face.

The width of the respective nontransparent (diffuse or opaque) regions and of the transparent regions can be varied to optimize the moire effect. In addition, by varying the configuration and shape of the transparent and nontransparent regions on the near and far surfaces of the envelopes 10,20 different moire patterns can be produced.

It will be evident to those having ordinary skill in the art that the foregoing description is merely illustrative, that the present invention may take a variety of alternative forms and that the scope of protection afforded the present invention is to be determined from the appended claims.

What is claimed is:

1. An article for creating a moire effect comprising a hollow envelope of an electric lamp having on its surface a plurality of alternating transparent and nontransparent regions arranged in a predetermined pattern such that when viewed from a point external to the object, nontransparent regions on a portion of the envelope surface furthest from the point are discernible through transparent regions on a portion of the envelope surface nearest to the point and through the interior of the envelope, nontransparent regions on the near and far portions of the envelope appearing to intersect at a plurality of intersection points, the apparent intersections defining a family of apparent curves each of which passes through apparent intersections of the nontransparent regions.

2. An article according to claim 1 wherein each of the plurality of nontransparent regions comprises an endless line segment.

3. An article according to claim 1 wherein the plurality of nontransparent regions appear as spaced line segments.

4. An article according to claim 3 wherein each line segment of the nontransparent regions extends radially on the envelope from the vicinity of a common pole, the majority of the line segments being transversely displaced from the pole to misalign the majority of the plurality of line segments from the pole.

5. An article according to claim 1 wherein the nontransparent regions are arranged along the surface of the envelope.

6. An article according to claim 1 further comprising a filament disposed within the envelope of sufficiently low brightness so that the moire effect is discernible.

7. An article according to claim 1 wherein the envelope has a substantially spherical portion on which the transparent and nontransparent regions are placed.

8. An article according to claim 1 wherein the plurality of nontransparent regions are substantially opaque.

9. An article according to claim 1 wherein the plurality of nontransparent regions are light diffusive.

10. An article according to claim 1 wherein the nontransparent regions comprise a plurality of line segments each of which extends along one of a plurality of parallel spaced planes.

11. An article according to claim 1 wherein said plurality of alternating transparent and nontransparent regions are on substantially all of the entire surface area of the envelope.

* * * * *